United States Patent [19]

McGrew

[11] 4,099,750

[45] Jul. 11, 1978

[54] METHOD OF FORMING EYE SPLICE IN DOUBLE BRAIDED LINE

[76] Inventor: James D. McGrew, 8120 Rio Linda Blvd., Elverta, Calif. 95626

[21] Appl. No.: 830,109

[22] Filed: Sep. 2, 1977

[51] Int. Cl.[2] ..... B65H 69/04

[52] U.S. Cl. ..... 289/1.5; 114/221 R

[58] Field of Search ..... 289/1.2, 1.5, 17, 18; 24/38; 28/141, 142; 87/13; 114/221 R

[56] References Cited

U.S. PATENT DOCUMENTS

| | | | |
|---|---|---|---|
| 296,377 | 4/1884 | Atwood | 28/141 X |
| 330,087 | 11/1885 | Binns | 289/1.2 X |
| 338,216 | 3/1886 | Atwood | 28/141 X |
| 782,120 | 2/1905 | Floyd | 114/221 R |
| 2,549,382 | 4/1951 | Mitterway | 28/141 X |
| 2,600,395 | 6/1952 | Domon et al. | 289/1.2 X |
| 2,698,986 | 1/1955 | Brown | 289/1.2 |
| 2,740,185 | 4/1956 | Silver | 289/1.2 |
| 3,385,619 | 5/1968 | Thomas et al. | 289/1.5 X |

FOREIGN PATENT DOCUMENTS

| | | | |
|---|---|---|---|
| 1,480,826 | 7/1977 | United Kingdom | 289/1.2 |

*Primary Examiner*—Louis K. Rimrodt
*Attorney, Agent, or Firm*—Lothrop & West

[57] ABSTRACT

A double braided line comprises a core covered by a sheath and a fid comprises an elongated flexible handle having a pointed end and a hooked end. After the size of the eye is established, a predetermined length of the core is pulled out of the sheath through an opening formed in the sheath and a knot is tied in the free end of the core. The hook of the fid is hooked around the knot and the end of the core is whipped to the fid. The fid and attached end of the core are snaked through the empty portion of the sheath back out the opening. The fid is removed from the end of the core and the hook attached to the end of the sheath with whipping, as before. The fid and attached end of the sheath are then pulled through the exposed portion of the core for a certain distance and the fid is removed from the end of the sheath. The core and sheath are thereafter alternately pulled to tighten the crossover of the core and sheath and bury the same in the sheath to complete the splice.

4 Claims, 19 Drawing Figures

METHOD OF FORMING EYE SPLICE IN DOUBLE BRAIDED LINE

BACKGROUND OF THE INVENTION

Owing to their numerous well-known advantages of lightness, strength and free running abrasion resistance qualities, double braided lines are widely used by many people such as yacht or boat owners, riggers, mountaineers and ranchers. Particularly in the nautical and marine arts, it often becomes necessary or desirable to splice an eye in the line.

The conventional method of forming an eye splice in a double braided line involves pulling the core of the line out of the sheath and feeding the end of the core back into the sheath in the opposite direction using a fid and a pusher. The end of the sheath is buried in the exposed portion of the core using the fid and pusher a second time and the exposed portion of the core and crossover are buried in the sheath by alternately pulling the various line components.

The fid which has been known heretofore is a rigid stick having one hollow end and one pointed end. The pointed end of the fid is tunneled through the center of the core or sheath and the end of the sheath or core, respectively, is pushed into the hollow end of the fid. The pusher is a rod which holds the end of the sheath or core in the hollow end of the fid and is used to push the fid and end of the sheath or core through the core or sheath, respectively.

This arrangement suffers from numerous disadvantages, one being that a different diameter fid must be provided for the different line diameters. It is necessary to provide a separate fid for each line carried on the vessel, and loss of one size fid can create a significant and annoying problem. Naturally, a set of fids is more expensive than one fid which would suffice for all line sizes. Another problem is that the end of the core or sheath in the hollow end of the fid tends to detach during passage through the sheath or core, respectively. Further, a fid of this design must be of the same diameter as the line since the end of the sheath must fit in the hollow end of the fid, and the fid is hard to push through the core. In summary, the conventional fid and pusher make eye splicing of doubled braided lines a difficult and often frustrating experience.

SUMMARY OF THE INVENTION

The present invention relates to an improved method of forming an eye splice in double braided line and a fid for practicing the method.

The conventional fid and pusher are replaced with a fid consisting of a flexible, elongated, small diameter handle having one pointed end. A hook extends from the other end of the handle. A knot is formed in the end of the core or sheath of the line and the hook is hooked therearound. The end is then whipped to the fid. The pointed end of the fid may then be readily inserted into the sheath or into the core, as required, and the fid and attached end of the core or sheath, respectively, worked therethrough with facility.

It is an object of the present invention to provide an improved method of forming an eye splice in double braided line.

It is another object of the present invention to provide a novel and unique fid for practicing the method.

It is another object of the present invention to provide a method of forming an eye splice which may be practiced using fewer and less expensive tools.

It is another object of the present invention to provide a method of forming an eye splice by which a single fid may be used for all sizes of line.

It is another object of the present invention to provide a method of forming an eye splice which makes it easier to push the fid through the line core or sheath, thus minimizing strain and abrasion of the core or sheath.

It is another object of the present invention to provide a generally improved method and apparatus for forming an eye splice in double braided line.

Other objects, together with the foregoing, are attained in the embodiment described in the following description and illustrated in the accompanying drawing.

DESCRIPTION OF THE PREFERRED EMBODIMENT

While the splicing apparatus of the invention is susceptible of numerous physical embodiments, and the method is capable of being practiced in a variety of ways, depending upon the environment and requirements of use, substantial numbers of the herein shown and described embodiment have been made, tested and used, in practicing the method disclosed, and have provided eminently satisfactory results.

Figure 1:
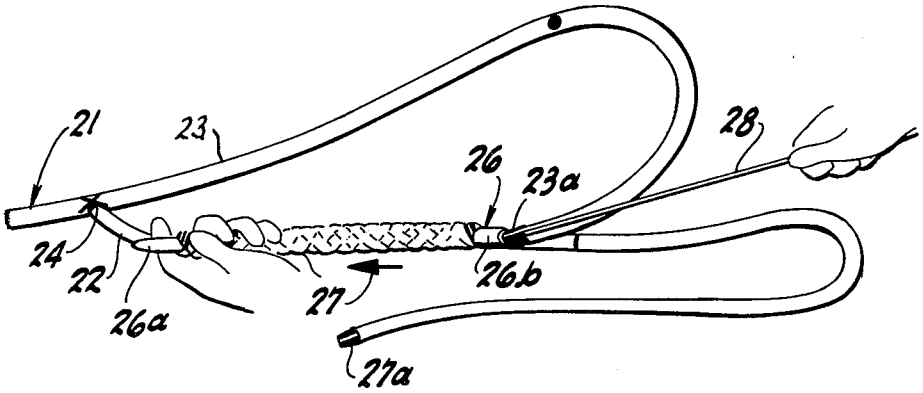
FIG-1 (PRIOR ART)
FIGS. 1 and 2 are diagrams illustrating the state of art.

FIG. 1 illustrates one step of a current widely used method of making an eye splice in the line being generally designated by the reference numeral 21 and comprising a braided core 22 and a braided sheath 23 with the core 22 shown as pulled out of an opening 24 in the sheath 23.

A prior art fid 26 is shown as buried in the core 22, the fid 26 having a pointed forward end **26*a* and a hollow after end 26*b*. The fid 26 is in the form of a rigid stick and has been pushed through the core 22 in the direction of the arrow 27, with the pointed end 26*a* leading. The end of the sheath 23 is taped as shown at 23*a* and inserted into the hollow end 26*b* of the fid 26. The pusher 28, or push rod, is then inserted into the taped end 23*a* of the sheath 23 and used to push the fid 26 and sheath end 23*a* through the core 22 so the fid 26 and the end 23*a* emerge from the core 22 at the position occupied by the end 26*a* of the fid 26 as illustrated in FIG. 1**.

Since the end **23*a* of the sheath 23 must be inserted into the hollow end 26*b* of the fid 26, the diameter of the fid 26 must be equal to that of the line 21, and a separate fid 26 must be provided for each diameter of line. Furthermore, it is difficult to push the large diameter fid 26 through the core 22. As yet another drawback, an examination of FIG. 1 reveals how the taped end 23*a* of the sheath 23 can easily become dislodged from the hollow end 26*b* of the fid 26 during passage through the core 22**.

Figure 2:
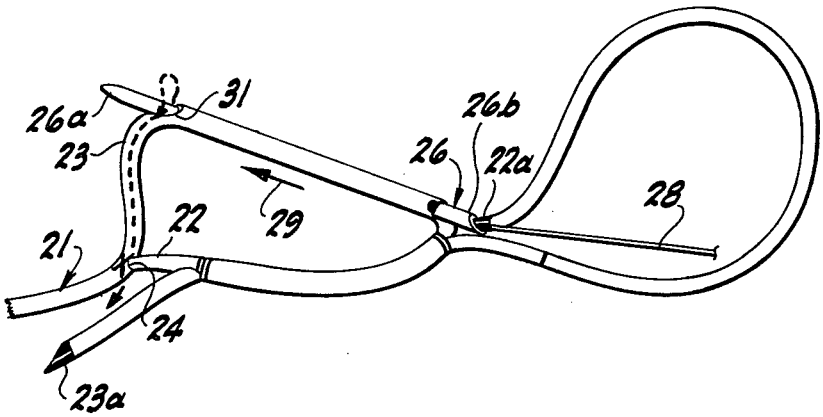
FIG-2 (PRIOR ART)

FIG. 2 shows a subsequent step in the prior art method and illustrates still other rather difficult manipulations. Here, the fid 26 is pushed through the empty sheath 23 in the direction of the arrow 29. The end of the core 22 is taped, as indicated at 22*a*, and inserted into the hollow end 26*b* of the fid 26. The pusher 28 is then used as in FIG. 1 to push the fid 26 and the taped end 22*a* of the core 22 through the sheath 23 to emerge at the opening 24. However, the fid 26 is rigid and is not long enough to reach completely through the length of the empty sheath 23 and must be removed and reinserted at an opening 31 formed in the sheath 23. This makes the process generally difficult and makes it especially hard effectively to reunite the end 22*a* of the core 22 with the end 26*b* of the fid 26 after the fid 26 is reinserted.

The drawbacks of the prior art process are eliminated by the present method, illustrated in FIGS. 3 to 19. The present method utilizes a fid 32 which comprises an elongated flexible handle 32*a* formed with a leading pointed end 32*b*. A hook 32*c* extends aft from the other end of the handle 32*a*. Preferably, the handle 32*a* is hollow with the leading pointed end 32*b* closed.

Figure 8:
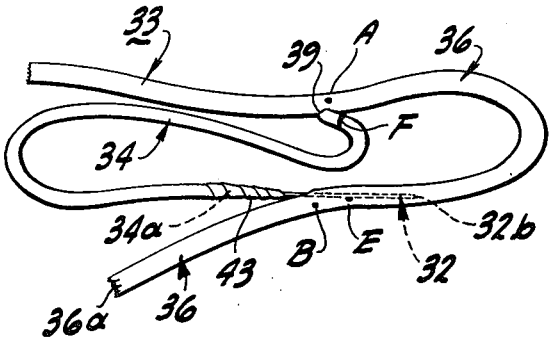

The double braided line is here designated as 33 and as best illustrated in FIG. 8 comprises a core 34 and sheath 36. As a preliminary step in practicing the present process, a mark is made (see FIG. 3) with a ball point pen 37 or the like at a point B on the sheath 36 at a distance from the end 36*a* of the sheath 36 which depends on the diameter of the line 33. More specifically, the distance from the end 36*a* of the sheath 36 to the point B is determined as follows:

| Line Size | Distance to B |
|---|---|
| 1/4" | 6" |
| 5/16" | 7" |
| 3/8" | 8" |
| 7/16" | 9 1/2" |
| 1/2" | 11" |
| 5/8" | 13" |

Figure 3:
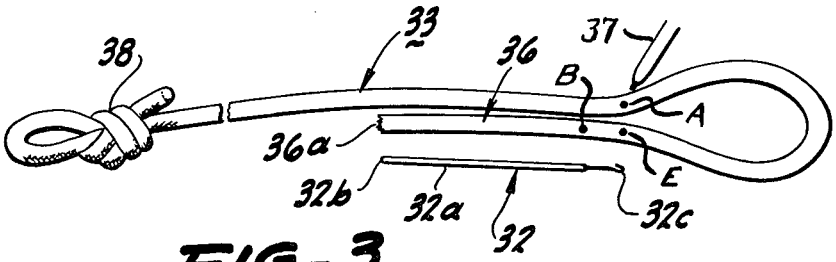
FIGS. 3 to 19 are diagrams illustrating the steps of the present method in generally sequential order.

The handle 32*a* of the fid 32 is then placed alongside the line 33, as shown in FIG. 3, so that the base of the hook 32*c* (i.e. where the hook joins the handle) indexes with the point B. A mark is then made on the sheath 36 at a point E which is spaced from the point B by the length of the hook 32*c*. The line 33 is then looped so that when a point A indexes with the point E the loop or eye thus formed has the desired size. A mark is then made at the point A. To control slack and allow the use of both hands while milking the sheath 36 over the core 34 in subsequent steps, an overhand knot 38 is tied in the line 33 about 3 feet from the point A (see FIG. 3).

Figure 4:
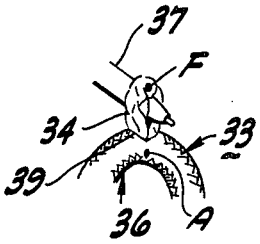

The first step of the actual process is shown in FIG. 4 in which an opening 39 is formed through the sheath 36 at the point A and the core 34 is pried up pulled out of the sheath 26 using the pen 37 or other suitable tool. As the core 34 is just being pulled out, a mark is made on the core at a point F, as shown. The core 44 is then completely pulled out of the sheath 36 as shown in FIG. 8.

Figure 5:
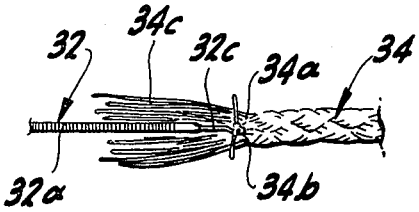

As the next step, the end 34*a* of the core 34 is unbraided as shown in FIG. 5 and a knot 34*b* is tied using two strands from opposite sides of the core 34. The hook 32*c* of the fid 32 is then hooked around the knot 34*b*.

Figure 6:
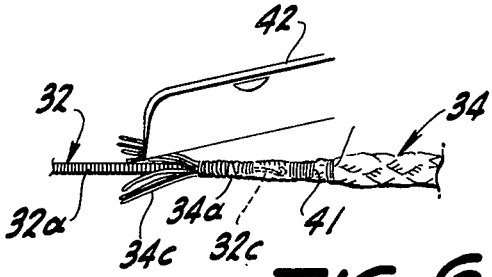

Next, as illustrated in FIG. 6, the unbraided portion of the end 34*a* of the core 34 is whipped to the fid 32, using dental floss or thread as indicated at 41. The loose ends of the strands are then cut close using a knife 42. The whipping 41 is made as tight as possible to facilitate the subsequent steps.

Figure 7:
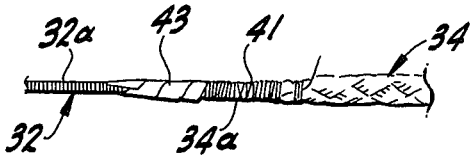

As shown in FIG. 7, a tight wrap 43 of cellophane tape is then made around the ends of the whipping 41 so as to form a smooth, thin, tapered transitional ferrule between the handle 32*a* of the fid 32 and the whipped end of the core 34.

Figure 9:
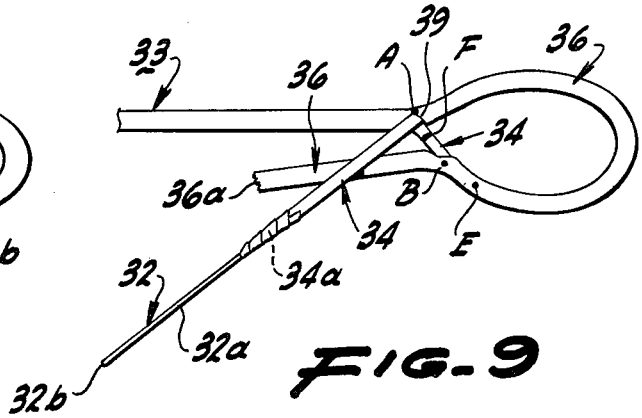
Figure 10:
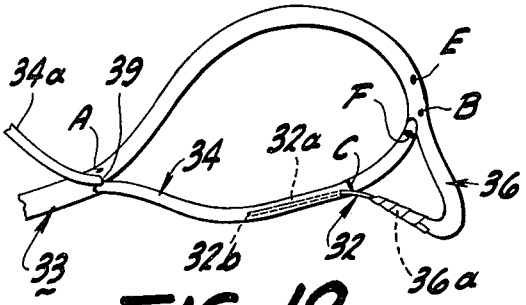
Figure 11:
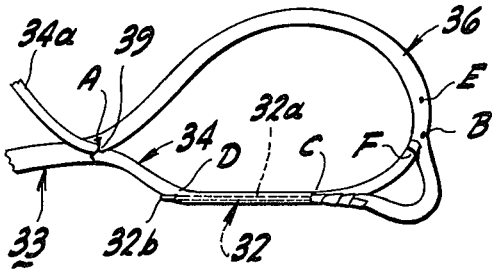

Next, the pointed end 32*b* of the fid 32 is inserted through the sheath wall into the tunnel defined by the empty sheath 36 at the point B and the fid 32 and end 34*a* of the core 34 are snaked or worked through the sheath 36 and brought out through the opening 39 at the point A. This is best seen in FIGS. 8 and 9. At this juncture, a significant length of the core 34 protrudes through the opening 39 and a significant length of empty sheath 36 is left between the point B and the end 36*a* of the sheath 36. The fid 32 is thereupon removed from the end 34*a* of the core 34 and attached to the end 36*a* of the sheath 36 in the manner illustrated in FIGS. 5 to 7.

The next step (see FIG. 10) involves pulling the core 34 farther out of the sheath 36 through the opening 39 so that a considerable amount of the core 34 is exposed between point F on the core and point A on the sheath.

The pointed end 32*b* of the fid 32 is then inserted into the exposed portion of the core 34 at a point C which is about 3 inches from the point F. The fid 32 is pushed through the core 34 until the whipped end 36*a* of the sheath 36 is buried in the center of the core 34, as appears in FIG. 11. The end 32*b* of the fid 32 is then caused to protrude at point D. Thereafter the fid 32 and end 36*a* of the sheath 36 are brought out of the core 34 at point D. The distance between the points C and D is substantially equal to the length of the handle 32*a* of the fid 32 and constitutes the length of the sheath 36 buried in the core 34. At this juncture, the end 36*a* of the sheath 36 protrudes through the outer side of the core 34.

Figure 12:
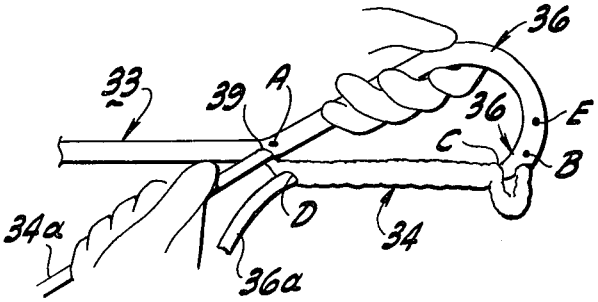
Figure 13:
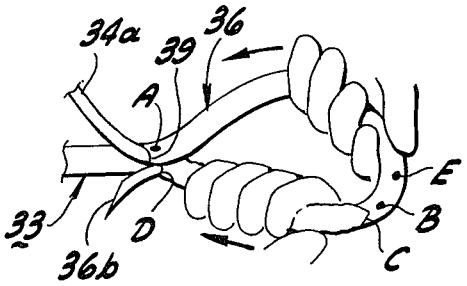

As shown in FIGS. 12 and 13, the loose ends 34*a* and 36*a* of the core 34 and sheath 36, respectively, are alternately pulled to bring the points B and C together. The end result of this step is shown in FIG. 13. The union of the points B and C is referred to as the "crossover" point of the core 34 and sheath 36. The loose end 36*a* of the core 36 is then cut off at a long angle as indicated in FIG. 13 at 36*b* adjacent to the point D. The fid 32 is removed from the cut off portion (not shown) of the sheath 36 for reuse. Pulling on the exposed portion of the core 34 will cause the cut off end 36*b* to disappear in the core.

Figure 14:
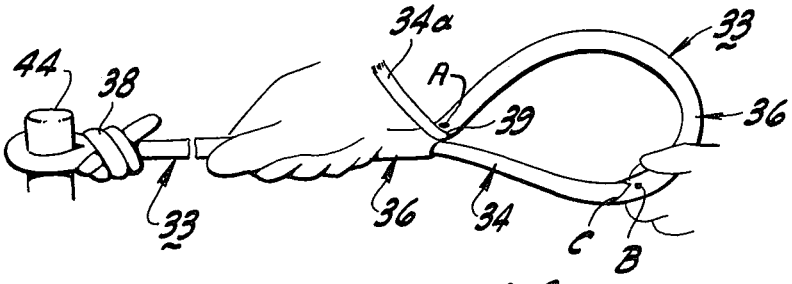
Figure 15:
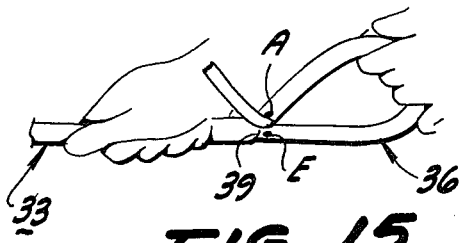

Next, the knot 38 is looped around a post 44, or the like, as shown in FIG. 14, and the portion of the sheath 36 below the point A is milked over the exposed portion of the core 34, using both hands. This process is continued until the crossover point B, C enters the sheath 36 of the main portion of the line 33 through the opening 39 and is buried therein. FIG. 15 shows the end result of this step by which the crossover point B, C is buried in the sheath 36 and the point E aligns with the point A. Thus, the crossover point B, C is buried in the sheath 36 by the distance between the points B and E which is equal to the length of the hook 32*c* of the fid 32.

Figure 16:
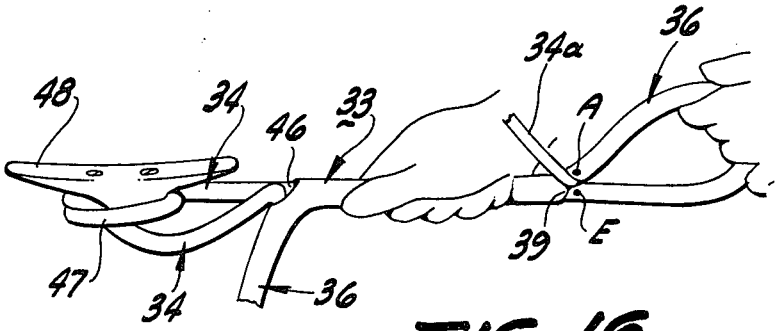

FIG. 16 shows how the core 34 may be pulled out of the sheath 36 to facilitate milking the sheath 36 over the core 34 to align the points A and E. More specifically, an opening 46 is formed in the sheath 36 between the knot 38 and the opening 39 and the core 34 is partially pulled out of the sheath 36. A riding turn 47 is temporarily taken around a cleat 48 to secure the core 34. After the points A and E are aligned, the core 34 is allowed to return inside the sheath 36 and the line 33 is smoothed out. This procedure is helpful where it is necessary to overcome friction on an old or tight line.

Figure 17:
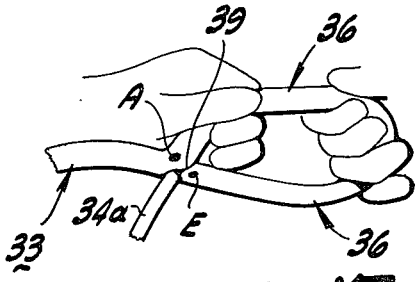
Figure 18:
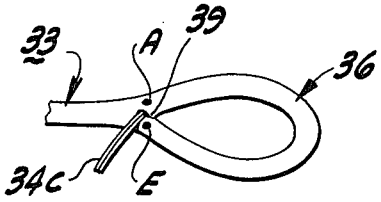
Figure 19:
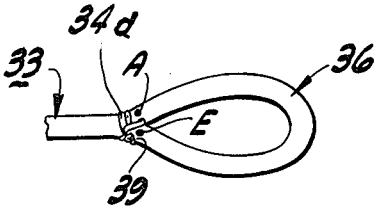

FIGS. 17 to 19 show how the eye splice produced by the above described method is finished by whipping. Although a simple whipping can be made around the throat of the splice (just below the point A) using a small cord, in which case the protruding end portion of the core 34 would be cut off and allowed to disappear into the splice, the following method produces a whipping of superior strength and appearance.

As illustrated in FIG. 17 the eye is smoothed out as much as possible so that it feels equally hard to the touch at all points. Then, all but a few, preferably six strands of the end 34*a* of the core 34 are cut off to a length of about ⅜ inch. These cut strands will disappear into the splice when tension is applied to the line 33. The remaining strands are designated as 34*c* in FIG. 18 and are tied around the throat of the splice just below the point A in a clove hitch designated as 34*d* in FIG. 19. The end of the clove hitch 34*d* is cut off to a length of about ⅜ inch and heated with a match or butane lighter. This causes the strands of the clove hitch 34*d* to melt. Pressing down smoothly on the clove hitch 34*d* with a moistened finger causes the clove hitch 34*d* to fuse and be positively prevented from unraveling.

In summary, the present invention provides a substantially improved method and fid for making eye splices in double braided line. The small dameter, flexible fid is easy to snake through the line core or sheath and does not need to be detached and reinserted to make a long run. Furthermore, only one size of fid will serve for lines of all sizes.

It is to be noted, furthermore, that while the hook 32*c* of the fid 32 is disclosed herein as being in the form of a recurved or open loop, it can also be of a closed loop configuration, depending upon the personal preference of the user. One form is considered to be the equivalent of the other.

What is claimed is:

1. A method of forming an eye splice in a double braided line having a core and a sheath using a fid having a flexible handle with a pointed end and a hook extending from the other end of the handle, comprising the steps of:

a. forming an opening in the sheath at a first point thereon;
b. pulling the core out of the sheath through the opening;
c. forming a knot in the end of the core;
d. hooking the hook of the fid around the knot in the end of the core;
e. whipping the end of the core to the fid;
f. inserting the pointed end of the fid into the sheath at a second point on the sheath between the first point and the end of the sheath, working the fid and core through the sheath to the opening and pulling the fid and the end of the core of the sheath through the opening;
g. removing the fid from the end of the core;
h. forming a knot in the end of the sheath;
i. hooking the hook of the fid around the knot in the end of the sheath;
j. whipping the end of the sheath to the fid;
k. pulling the core farther out of the sheath through the opening;
l. inserting the pointed end of the fid into the core at a third point on the core between the first and second points, working the fid and sheath through the core to a fourth point on the core between the third and first points and pulling the fid and the end of the core out of the sheath at the fourth point;
m. removing the fid from the end of the sheath;
n. pulling the ends of the sheath and core to bring the second point on the sheath and the third point on the core together; and,
o. milking the sheath over the core so that the second point on the sheath and the third point on the core enter the sheath through the opening.

2. A method as in claim 1 further comprising the step of:

p. applying a whipping to the sheath just below the opening.

3. A method as in claim 1 in which step (p) comprises cutting off all but a predetermined number of strands from the end of the core, tying remaining strands around the sheath just below the opening and applying heat to the remaining strands to fuse the same.

4. A method as in claim 1 in which step (p) comprises tying the remaining strands around the sheath in a clove hitch.

* * * * *